US007445048B2

(12) United States Patent
Sheffield

(10) Patent No.: US 7,445,048 B2
(45) Date of Patent: Nov. 4, 2008

(54) PLUNGER LIFT APPARATUS THAT INCLUDES ONE OR MORE SENSORS

(75) Inventor: Randolf J. Sheffield, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 356 days.

(21) Appl. No.: 10/904,324

(22) Filed: Nov. 4, 2004

(65) Prior Publication Data

US 2006/0090893 A1 May 4, 2006

(51) Int. Cl.
*E21B 43/12* (2006.01)

(52) U.S. Cl. ..... 166/372; 166/250.15; 166/53; 166/105

(58) Field of Classification Search ..... 166/250.15, 166/53, 153, 105, 250.01, 369, 370, 277
See application file for complete search history.

(56) References Cited

U.S. PATENT DOCUMENTS 4,526,228 A 7/1985 Wynn
4,889,473 A * 12/1989 Krueger ..... 417/56
4,921,048 A 5/1990 Crow et al.
4,923,372 A 5/1990 Ferguson et al.
4,989,671 A 2/1991 Lamp
5,132,904 A 7/1992 Lamp
5,146,991 A 9/1992 Rogers, Jr.
RE34,111 E 10/1992 Wynn
5,785,123 A 7/1998 Lea, Jr.
5,878,817 A 3/1999 Stastka
6,170,573 B1 * 1/2001 Brunet et al. ..... 166/153
6,634,426 B2 10/2003 McCoy et al.
6,831,571 B2 * 12/2004 Bartel ..... 340/854.6
7,219,725 B2 * 5/2007 Chisholm ..... 166/68
2002/0007952 A1 * 1/2002 Vann ..... 166/369
2002/0074118 A1 6/2002 Fisher
2002/0174983 A1 11/2002 Swoyer et al.
2003/0145986 A1 8/2003 Evans et al.
2004/0256113 A1 * 12/2004 LoGiudice et al. ..... 166/381
2005/0087368 A1 * 4/2005 Boyle et al. ..... 175/57
2005/0178543 A1 * 8/2005 Giacomino ..... 166/250.01

FOREIGN PATENT DOCUMENTS

RU 2132459 C1 6/1999

* cited by examiner

*Primary Examiner*—David J Bagnell
*Assistant Examiner*—Robert E Fuller
(74) *Attorney, Agent, or Firm*—Dan C. Hu; Kevin B. McGoff; Bryan P. Galloway

(57) ABSTRACT

A plunger lift apparatus includes wellhead equipment containing a receiver, a conduit extending from the wellhead equipment into a wellbore, and a plunger to be run through the conduit to a downhole location in the wellbore. The plunger includes at least a sensor to measure a downhole parameter, and a plunger is adapted to communicate the measured downhole parameter to the receiver.

27 Claims, 3 Drawing Sheets

106
136
114
120
122
202
204
206

PLUNGER LIFT APPARATUS THAT INCLUDES ONE OR MORE SENSORS

TECHNICAL FIELD

This invention relates generally to a plunger lift apparatus and method that includes one or more sensors.

BACKGROUND

To produce hydrocarbons from a subterranean reservoir, one or more wellbores are drilled through the earth formation to the reservoir. Each wellbore is then completed by installing casing or liner sections and by installing production tubing, packers, and other downhole components. For certain types of wells, artificial lift systems are installed to enhance the production of hydrocarbons. One such artificial lift system includes an electrical submersible pump that pumps fluids from a downhole location in a wellbore to the well surface. Another type of artificial lift system is a gas lift system, where pressurized gas (pumped from the surface of the well or from an adjacent wellbore) is used to lift well fluids from a downhole location in the wellbore.

Yet another type of artificial lift mechanism is a plunger lift production mechanism often used to remove oil or other liquids from gas wells. Gas wells that require swabbing, soaping, blowing down, or stop cocking are candidates for plunger lift production mechanisms. A plunger lift production mechanism typically includes a relatively small cylindrical plunger that travels through tubing extending from a downhole location adjacent a producing reservoir to surface equipment located at the open end of the wellbore. In general, liquids that collect in the wellbore and inhibit the flow of gas out of the reservoir and into the wellbore are collected in the tubing. Periodically, the end of the tubing is opened at the surface and the accumulated reservoir pressure is sufficient to force the plunger up the tubing. The plunger carries with it to the surface a load of accumulated fluids that are ejected out of the top of the well to allow gas to flow more freely from the reservoir into the wellbore and to a distribution system at the well surface. After the flow of gas has again become restricted due to further accumulation of fluids downhole, a valve in the tubing at the well surface is closed so that the plunger falls back down the tubing for lifting another load of fluids to the well surface upon reopening of the valve.

In plunger lift production mechanisms, there is a requirement for the periodic operation of a motor valve at the wellhead to control the flow of fluids from the well to assist in the production of gas and liquids from the well. Conventionally, a motor valve is controlled by a timing mechanism that is programmed in accordance with principles of reservoir engineering to determine the length of time that the well should either be "shut in" (and restricted from flowing) and a time the well should be "opened" to freely produce. Generally, the criterion used for operation of the motor valve is strictly based on a pre-selected time period. In most cases, parameters such as well pressure, temperature, and so forth, are not available in conventional plunger lift production mechanisms because of the costs associated with intervention to obtain well pressure, temperature, and other information.

Operation of a motor valve based only on time is often not adequate to control outflow from the well to enhance well production. Proper setting of logic to control the plunger lift production mechanisms usually is based on trial and error, with continued evaluation needed for changing well performance that necessitates well site trips to adjust timing for the control of motor valves.

SUMMARY

In general, according to the invention, a plunger lift production mechanism includes a plunger having one or more sensors to measure well parameters to enable operation of the plunger lift production mechanism based on the measured well parameters. For example, a plunger lift apparatus includes wellhead equipment containing a receiver, a conduit extending from the wellhead equipment into a wellbore, and a plunger adapted to be run through the conduit to a downhole location in the wellbore. The plunger includes at least a sensor to measure a downhole parameter, where the plunger is adapted to communicate the measured downhole parameter to the receiver.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
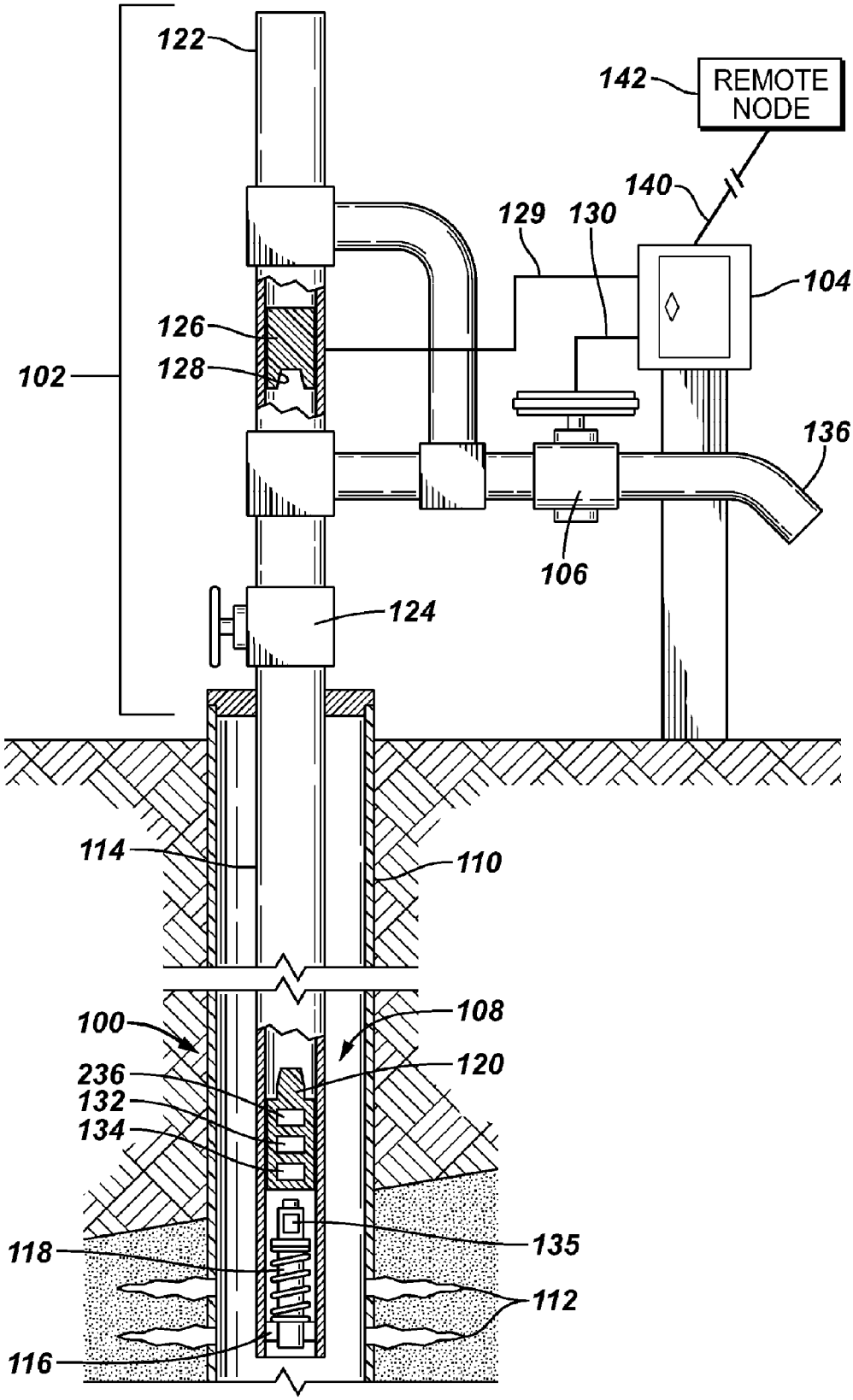
FIG. 1 illustrates well equipment that includes a plunger lift production mechanism according to an embodiment.

FIG. 1 illustrates equipment associated with a well that includes a plunger lift production mechanism 100, wellhead equipment 102, an electronic controller 104, and a motor valve 106. A wellbore 108 is lined with casing or liner 110, with perforations 112 formed at a wellbore interval to enable the communication of wellbore fluids with surrounding formation. A tubing 114 extends from the wellhead equipment 102 to the wellbore interval adjacent the perforated region of the casing and formation. A tubing stop 116 is located at the bottom portion of the tubing 114, with the tubing stop 116 including a bleed valve. Above the tubing stop 116 is a bumper spring 118 that is used for receiving a traveling plunger 120 (a plunger that travels between a downhole location and the well surface). The bumper spring 118 includes a spring that absorbs shock when the plunger 120 is dropped onto the bumper spring 118.

The wellhead equipment 102 includes a lubricator 122, and a master valve 124 for shutting in the wellbore during insertion of intervention equipment through the lubricator 122. Also, a catch 126 is provided between the master valve 124 and the lubricator 122. The catch 126 includes a receiver 128 to receive the plunger 120. The receiver in the catch 126 provides both a physical (mechanical) and electrical connection to the plunger 120. The electrical connection enables electrical communication (of power and signaling) over a cable 129 with the electronic controller 104. In addition, the receiver 128 in the catch 126 has a telemetry element to enable wired or wireless communication with the plunger 120. Wireless communications may include electromagnetic, radio frequency (RF), infrared, inductive coupler, pressure pulse, or other forms of wireless communications. RF and inductive coupler communications between the receiver 128 and plunger 120 may be most efficient.

The electronic controller 104 is connected over a link 130 to the motor valve 106. The electronic controller 104 controls the motor valve 106 to determine when the motor valve 106 is to be opened or closed. When opened, the motor valve 106 enables flow of well fluids, such as gas, out of the wellbore through pipe 136. Although referred to as a "motor valve," other types of valves or flow control devices can be used in other embodiments.

In accordance with some embodiments of the invention, the plunger 120 includes one or more sensors 132, 134 that are used for measuring characteristics associated with the wellbore and surrounding formation. As used here, the term "plunger" refers to any moveable element that is capable of traveling through at least a portion of the wellbore. The sensors 132, 134 communicate through a telemetry element 236 with the corresponding telemetry element in the receiver 128 of the catch 126. As noted above, such communication includes wireless or wired communications. The measured characteristics are communicated from the sensors 132, 134 through the receiver 128 to the electronic controller 104.

Examples of measured characteristics include pressure, temperature, other well characteristics such as fluid flow rate, fluid density, formation characteristics such as formation pressure, formation resistivity, and other downhole characteristics. More generally, the sensors measure downhole parameters. The provision of sensors 132, 134 allows the electronic controller 104 to determine when the motor valve 106 should be opened or closed. In addition to timing criterion programmed into the electronic controller 104, the electronic controller 104 takes into account data from the sensors 132, 134 to control opening and closing of the motor valve 106. The sensors 132, 134 are powered by a power source, such as a battery.

By being able to monitor downhole environment information (information pertaining to well characteristics, formation or reservoir characteristics, and/or other downhole parameters) using the sensors 132, 134, the electronic controller 104 is able to automatically adjust the operation of the plunger lift production mechanism, thus eliminating manual intervention by the well operator for determining when the motor valve 106 needs to be opened or closed. Consequently, trial-and-error approaches to plunger lift control can be avoided or reduced. For example, motor valve 106 can be controlled to lift the plunger 120 or allow the plunger 120 to drop back into the wellbore in response to preset pressure thresholds as measured by the sensor 132 or 134 in the plunger 120.

Additionally, the electronic controller 104 is configured to communicate measurement data (from the sensors 132, 134) over a network 140 (wired and/or wireless network) to a remote node 142. The electronic controller 104 is also able to communicate operational information regarding operation of the plunger lift production mechanism 100 to the remote node 140.

Measured downhole parameters can also be communicated to the remote node 142, or processed locally at the wellsite, to evaluate the reservoir and field associated with the wellbore. For example, the measured downhole parameters can be compared to historical information of the reservoir or surrounding reservoirs. The sensors provided in the traveling plunger 120 enable acquisition of the downhole parameters without the use of an expensive or highly sophisticated telemetry system. Integrating the sensors 132, 134 into the plunger lift production mechanism allows well monitoring to be provided as an integral part of the relatively low cost plunger lift production mechanism without additional wellbore infrastructure. Consequently, administrative and production costs related to well production supervision can be reduced.

Alternatively, the telemetry element 236 can communicate wirelessly with the receiver 128 (as the wellhead) from a remote location, such as a remote location in the wellbore. To enable long distance wireless communication, the plunger 120 can be fitted with a larger capacity power source, such as a high-capacity battery.

In an alternative embodiment, instead of providing a sensor in the plunger, a sensor (or sensors) 135 can be positioned in a stationary location downhole in the wellbore (such as proximate the bumper string 118). In this alternative embodiment, the traveling plunger acts as a telemetry device to communicate the information from the downhole stationary sensor 135 to the surface receiver 128. The traveling plunger can download information from the downhole stationary sensor 135 to a storage 133 (FIG. 3) in the plunger when the plunger is positioned downhole proximate this sensor 135. The communication between the plunger and the sensor can be wired communication or wireless communication (e.g., electromagnetic, inductive coupler, etc.). The stored information (in the storage 133 of the sensor) is carried by the plunger to the surface, where the stored information is communicated through the receiver 128 to the controller 104.

Figures 2A, 2B, 2C, 2D, 2E:
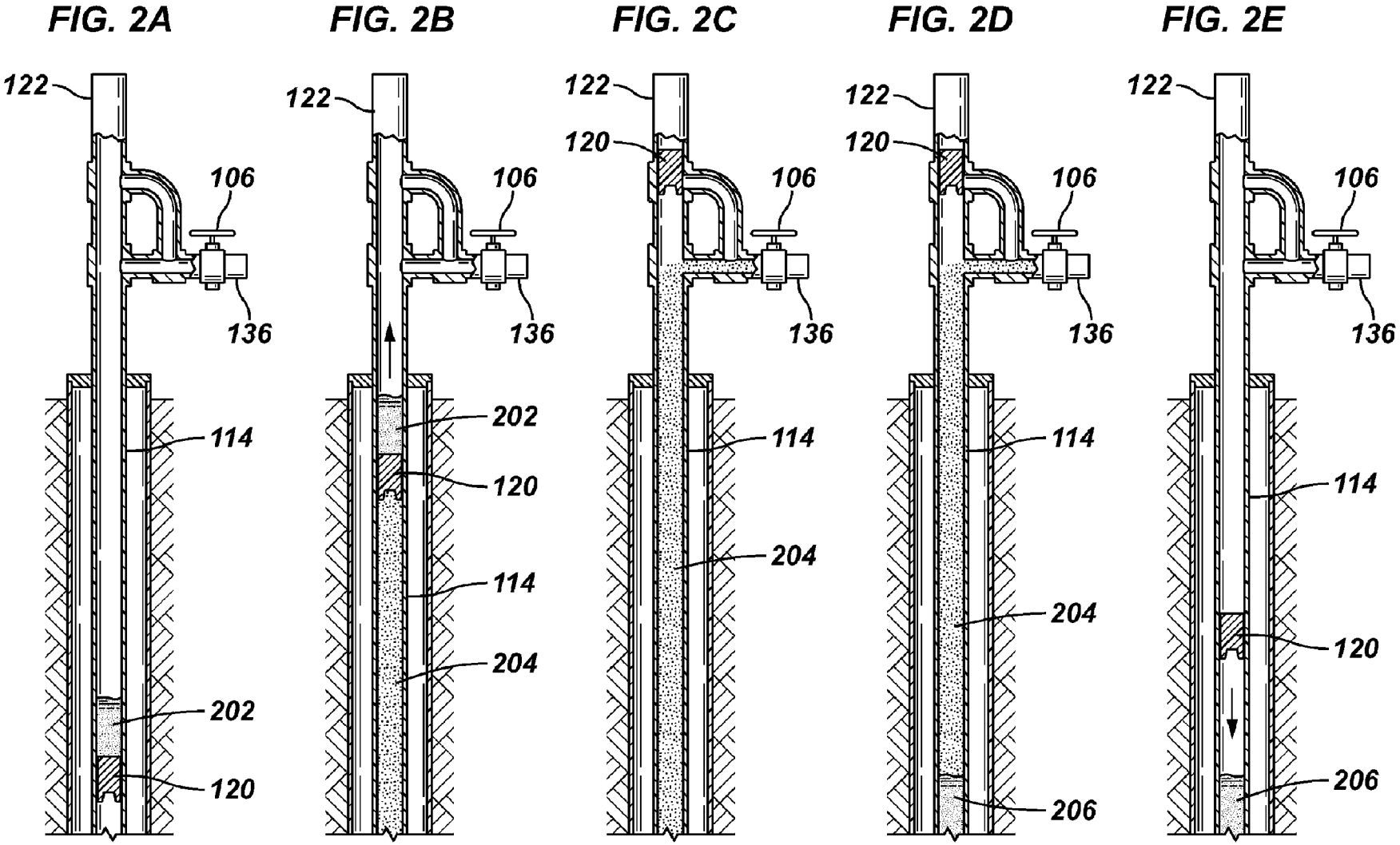
FIGS. 2A-2E illustrate an example operation of the plunger lift production mechanism according to an embodiment.

FIGS. 2A-2E illustrate an example operation of the plunger lift production mechanism under control of the electronic controller 104. Initially, as illustrated in FIG. 2A, the well is closed (the motor valve 106 is closed). Pressure in the wellbore builds (as a result of gas from the surrounding reservoir entering the wellbore through perforations 112 of FIG. 1), with a liquid column 202 building above the plunger 120 that is located at the bottom of the tubing 114. Note that the plunger 120 is sitting on the bumper spring 118 (FIG. 1).

Next, as depicted in FIG. 2B, the motor valve 106 is opened by the electronic controller 104, which allows the built-up pressure in the wellbore to move the plunger 120 (and the liquid column 202) upwardly towards the wellhead equipment. The decision to open the motor valve 106 can be based on a timing criterion and/or measured downhole parameters (either parameters measured previously or in real time). As depicted in FIG. 2B, gas flow 204 is provided underneath the plunger 120 to move the plunger 120 upwardly. When the plunger 120 is received in the catch 126 (FIG. 1), as depicted in FIG. 2C, the gas flow is allowed to pass by the plunger 120 and through the conduit 136 (with the motor valve 106 still open). As depicted in FIG. 2D, as liquids accumulate in the wellbore, the velocity of gas flow drops. Upon detection of the reduced gas flow, the electronic controller 104 shuts the motor valve 106. Once the motor valve 106 is shut, the plunger 120 is allowed to drop toward the accumulated liquid column 206 at the bottom of the tubing 114, as depicted in FIG. 2E. The plunger 120 drops to the bottom of the tubing 114 to the position depicted in FIG. 2A. The process of FIGS. 2A-2E is then repeated.

Figure 3:
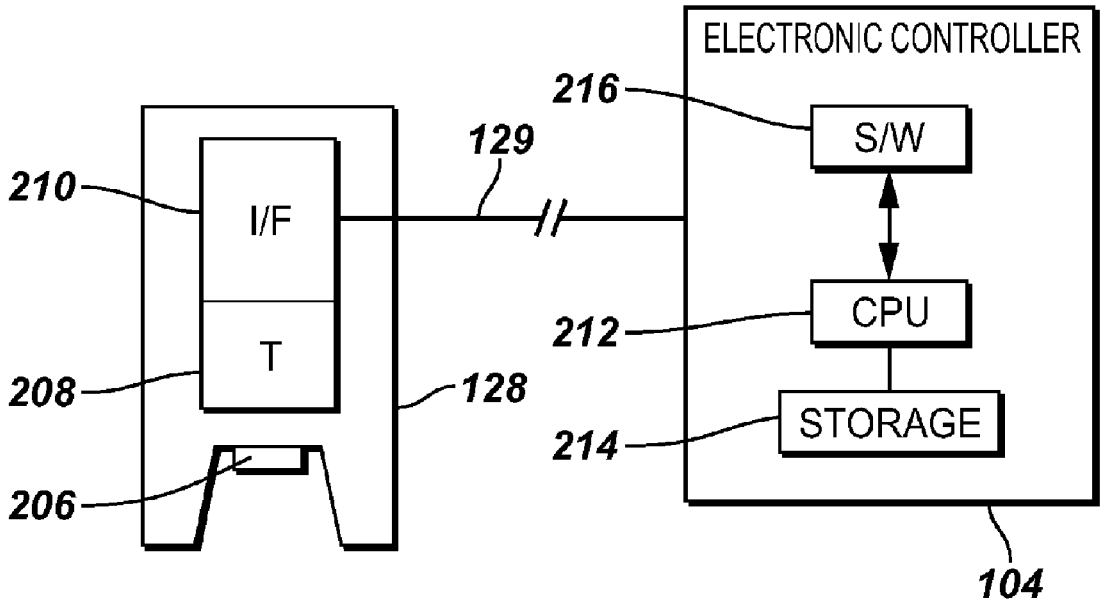
FIG. 3 is a block diagram of components of a plunger and a receiver in the plunger lift production mechanism of FIG. 1.
Figure 3:
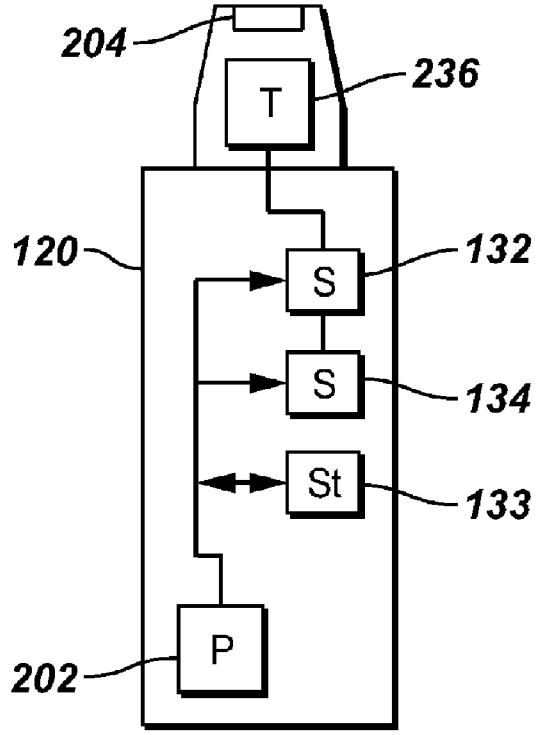

As depicted in FIG. 3, the components of the plunger 120 and the receiver 128 are depicted in greater detail. The plunger 120 includes the sensors 132, 134. Note that the plunger 120 can include less than or more than the two sensors 132, 134 depicted in FIG. 3. The sensors 132, 134 are powered by a power source 202, which can be a battery, a capacitor, or a combination of a battery and capacitor. Other power sources can also be used in other embodiments. The sensors 132, 134 are coupled to the telemetry element 236. Also, at the upper end of the plunger 120 is a connector 204 for connection to a mating connector 206 in the receiver 128. The connectors 204, 206 enable electrical connection between the plunger 120 and the receiver 128 to allow wired electrical communication. Also, the electrical connection enables the receiver 128 to charge the power source 202 in the plunger 120.

Alternatively, instead of a wired connection between connectors 204 and 206, the telemetry element 236 is capable of wireless communications, such as electromagnetic communications, RF communications, inductively-coupled communications, infrared communications, pressure pulse communications, and so forth. The telemetry element 236 can, for example, communicate wirelessly with a telemetry element 208 in the receiver 128. Thus, the telemetry elements 236, 208 can be electromagnetic telemetry units (for communicating electromagnetic signals), radio frequency telemetry units (for communicating radio frequency signals), inductively coupled telemetry units, infrared telemetry units (for communicating infrared signals), or pressure pulse telemetry units (to communicate pressure pulse signals).

The telemetry element 208 is connected to an interface 210 in the receiver 128. The interface 210 communicates over the cable 129 with the electronic controller 104. The electronic controller 104 includes a central processing unit (CPU) 212 and an associated storage 214. Software modules in the electronic controller 104 are executable on the CPU 212. Such software modules 216 include software modules to receive and process measurement information from the sensors 132, 134. The software modules 216 also are capable of communicating with the remote node 142 (FIG. 1) to communicate measurement information, as well as other operational information associated with the plunger lift production mechanism. The software modules 216 can also include software to process information gathered from the sensors 132, 134 to monitor the performance of the wellbore as well as to control operation of the plunger lift production mechanism. For example, one such software module can be programmed with timing intervals at which the plunger mechanism should be cycled between its well surface position and downhole position, taking into account the downhole parameters measured from the sensors 132, 134.

The software modules 216 can also evaluate performance of the plunger lift production mechanism based on the measured downhole parameters associated with the wellbore, field, and reservoir. The cycling of the plunger 120 can be adjusted based on the evaluated performance.

The plunger 120 can also be configured to include pressurized gas that is bled off by a low power relief valve while at the well surface lubricator. When the monitored wellbore pressure crosses a predetermined threshold, the pressurized gas can be bled off to cause the plunger 120 to be able to drop back into the wellbore.

Also, maintenance of the plunger lift production mechanism can be optimized and better scheduled by enabling remote monitoring at the remote node 142.

Instructions of such software routines or modules are stored on one or more storage devices in the corresponding systems and loaded for execution on corresponding processors. The processors include microprocessors, microcontrollers, processor modules or subsystems (including one or more microprocessors or microcontrollers), or other control or computing devices. As used here, a "controller" refers to hardware, software, or a combination thereof. A "controller" can refer to a single component or to plural components (whether software or hardware).

Data and instructions (of the software) are stored in respective storage devices, which are implemented as one or more machine-readable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; and optical media such as compact disks (CDs) or digital video disks (DVDs).

While the invention has been disclosed with respect to a limited number of embodiments, those skilled in the art will appreciate numerous modifications and variations there from. It is intended that the appended claims cover such modifications and variations as fall within the true spirit and scope of the invention.

What is claimed is:

1. A plunger lift apparatus, comprising:

wellhead equipment containing a receiver;

a conduit for extending from the wellhead equipment into a wellbore:

a plunger adapted to travel through the conduit to a downhole location in the wellbore, wherein the plunger includes at least a sensor to measure a downhole pressure parameter, wherein the plunger is adapted to communicate the measured downhole pressure parameter to the receiver;

a controller; and a valve at the wellhead equipment controlled by the controller, wherein the controller is adapted to receive pressure data measured by the sensor in the plunger, the controller adapted to base control of the valve at least in part on the pressure data measured by the sensor in the plunger.

2. The plunger lift apparatus of claim 1, wherein the controller is part of the wellhead equipment, and wherein operation of the valve by the controller at the wellhead equipment controls rise and fall of the plunger in the conduit.

3. The plunger lift apparatus of claim 1, wherein the plunger is adapted to rise and fall autonomously in the conduit based on the measured downhole pressure parameter.

4. The plunger lift apparatus of claim 1, wherein the controller is adapted to further base control of the valve on a timing criterion.

5. The plunger lift apparatus of claim 1. further comprising an electrical link between the receiver and the controller.

6. The plunger lift apparatus of claim 1, wherein the plunger includes a first wireless telemetry unit and the receiver includes a second wireless telemetry unit, the first and second wireless telemetry units to communicate wirelessly to enable communication of pressure data measured by the sensor to the receiver.

7. The plunger lift apparatus of claim 6, wherein the first and second wireless telemetry units comprise electromagnetic wireless telemetry units.

8. The plunger lift apparatus of claim 6, wherein the first and second wireless telemetry units comprise radio frequency telemetry units.

9. The plunger lift apparatus of claim 6, wherein the first and second wireless telemetry units comprise inductive coupler telemetry units.

10. The plunger lift apparatus of claim 6, wherein the first and second telemetry units comprise pressure pulse telemetry units to communicate data over pressure pulses.

11. The plunger lift apparatus of claim 6. wherein the first and second telemetry units comprise infrared telemetry units.

12. The plunger lift apparatus of claim 6, wherein the controller includes timing logic, the controller to base control of the valve on the timing logic and pressure data measured by the sensor in the plunger.

13. The plunger lift apparatus of claim 1, wherein the sensor is adaptcd to further measure a temperature parameter in a wellbore interval.

14. The plunger lift apparatus of claim 1, wherein the sensor is adapted to further measure another downhole parameter selected from among a fluid flow rate, fluid density, reservoir pressure, and formation resistivity.

15. The plunger lift apparatus of claim 1, wherein the plunger includes a power source to provide power to the sensor.

16. The plunger lift apparatus of claim 15, wherein the power source is adapted to be charged by the receiver in response to the plunger being engaged in the receiver.

17. The plunger lift apparatus of claim 1, wherein the plunger includes a first electrical connector and the receiver includes a second electrical connector, the first and second electrical connectors adapted to be connected with each other to enable electrical communication between the sensor and the receiver.

18. The plunger lift apparatus of claim 1, wherein the controller receives the measured downhole pressure parameter from the sensor through the receiver, the controller adapted to communicate over a network to a remote node, the controller to send the measured downhole pressure parameter to the remote node over the network.

19. The plunger lift apparatus of claim 1, wherein the controller controls operation of the plunger based on the measured downhole pressure parameter, wherein the controller is adapted to cause the plunger to be cycled between a position at the wellhead equipment and a downhole position.

20. The plunger lift apparatus of claim 1, wherein the controller controls the valve based directly at least in part on the pressure data measured by the sensor in the plunger.

21. A plunger lift apparatus. comprising:

wellhead equipment containing a receiver;

a conduit for extending from the wellhead equipment into a wellbore:

a plunger adapted to travel through the conduit to a downhole location in the wellbore, wherein the plunger includes at least a sensor to measure a downhole parameter, wherein the plunger is adapted to communicate the measured downhole parameter to the receiver;

a controller to control operation of the plunger based on the measured downhole parameter, wherein the controller is adapted to cause the plunger to be cycled between a position at the wellhead equipment and a downhole position: and a valve at the wellhead equipment adapted to be actuated by the controller based on the measured downhole parameter from the sensor, wherein opening and closing of the valve causes movement of the plunger in the conduit.

22. A method to provide artificial lift in a wellbore, comprising:

running a plunger of a plunger lift apparatus through a conduit in the wellbore;

providing at least a stationary sensor in the wellbore;

providing a receiver at wellhead equipment of the wellbore;

downloading a measured downhole parameter from the stationary sensor to a storage in the plunger;

moving the plunger to a position proximate the receiver; and communicating the measured downhole parameter from the storage of the sensor to the receiver, wherein communicating the measured downhole parameter between the sensor and the receiver comprises communicating wirelessly between a telemetry unit in the plunger and a telemetry unit in the receiver.

23. The method of claim 22, further comprising measuring the downhole parameter with the stationary sensor, wherein measuring the dowuhole parameter comprises measuring a parameter selected from among a temperature, pressure, fluid flow rate, fluid density. reservoir pressure, reservoir resistivity.

24. A method to provide artificial lift in a wellbore, comprising:

running a plunger of a plunger lift apparatus through a conduit in the wellbore;

providing at least a sensor in the plunger;

providing a receiver at wellhead equipment of the wellbore;

communicating a measured downhole parameter from the sensor to the receiver;

communicating the measured downhole parameter to a controller;

providing a valve at the wellhead equipment to control movement of the plunger; and the controller opening and closing the valve based at least in part on the measured downhole parameter.

25. The method of claim 24, wherein the controller opens and closes the valve based further on a timing criterion.

26. The method of claim 24, wherein the controller opens and closes the valve based directly at least in part on the measured downhole parameter.

27. A plunger lift system, comprising:

wellhead equipment containing a receiver, the receiver including a first telemetry element;

a conduit extending from the wellhead equipment into a wellbore;

a sensor for positioning downhole in the wellbore; and a plunger moveable in the conduit between the wellhead equipment and a location proximate the sensor, the plunger including a second telemetry element to communicate with the first telemetry element, the plunger to receive a downhole parameter measured by the sensor, the plunger having a storage to store the received downhole parameter, the plunger to communicate the stored downhole parameter to the receiver through the first and second telemetry elements, wherein the first and second telemetry elements comprise one of: (1) first and second wireless telemetry elements to communicate wirelessly, and (2) first and second electrical connectors that are connected to each other when the plunger is positioned at the receiver in the wellhead equipment, and that are disconnected when the plunger is positioned away from the receiver.

* * * * *